US005873761A

United States Patent [19]

Johnson

[11] Patent Number: 5,873,761

[45] Date of Patent: Feb. 23, 1999

[54] AERODYNAMIC TOY

[76] Inventor: Michael W. Johnson, 157-144 Porthsmouth Blvd., Winnipeg Manitoba, Canada, R3P 1B6

[21] Appl. No.: 831,694

[22] Filed: Apr. 10, 1997

[30] Foreign Application Priority Data

Apr. 16, 1996 [CA] Canada ..... 2174303

[51] Int. Cl.[6] ..... A63H 27/00

[52] U.S. Cl. ..... 446/47; 446/46; 446/48

[58] Field of Search ..... 446/34, 36, 46, 446/47, 48; 473/588, 589

[56] References Cited

U.S. PATENT DOCUMENTS

| | | | |
|---|---|---|---|
| 2,835,073 | 5/1958 | Dame | 46/76 |
| 3,613,295 | 10/1971 | Everett | 46/74 |
| 3,786,246 | 1/1974 | Johnson et al. | 446/47 |
| 3,852,910 | 12/1974 | Everett | 46/74 D |
| 4,075,781 | 2/1978 | Hill, II et al. | 446/48 |
| 4,216,611 | 8/1980 | Psyras | 46/74 D |
| 4,297,809 | 11/1981 | Branson | 446/46 |
| 4,337,950 | 7/1982 | Gidge | 273/426 |
| 4,856,793 | 8/1989 | Hannifan | 446/47 |
| 5,269,716 | 12/1993 | Viola | 446/48 |
| 5,319,531 | 6/1994 | Kutnyak | 446/47 |
| 5,484,159 | 1/1996 | Dean et al. | 446/46 |

*Primary Examiner*—Jennifer Bahr
*Assistant Examiner*—Charles Marmor, II
*Attorney, Agent, or Firm*—Murray E. Thrift; Adrian D. Battison

[57] ABSTRACT

The present invention relates to an aerodynamic toy particularly of the type for manually launching into the air. The toy includes a disc shaped body having a plurality of airfoil shaped sections, and a plurality of slots in the body. Light emitting devices and sound generating devices may also be included to enhance the amusement value of the toy. It is believed that airfoil shaped disc sections, depressions in the bottom of the disc body, and slots in the body improve the aerodynamic characteristics of the toy enabling it to remain in the air for a longer period of time when thrown, and cause the toy to tend to level itself while airborne.

14 Claims, 2 Drawing Sheets

AERODYNAMIC TOY

FIELD OF THE INVENTION

The present invention relates to an aerodynamic toy particularly of the type for manually launching into the air.

BACKGROUND

Disc shaped toys which can be thrown through the air to another person, or for distance, are well known. These toys are popular and are used by both children and adults.

Various attempts have been made to improve these toys to make them more amusing for the individual using the toy. Interesting shapes and colours have been applied to the discs of various disc shaped toys to achieve this end. Other attempts have been made to improve these toys by improving the aerodynamics of the toy to increase the time in flight, to improve the hovering abilities, and to improve the ability of the toy to remain upright and level in flight.

SUMMARY

According to the present invention there is provided an aerodynamic toy for manually launching into flight comprising:

a disc shaped body having a substantially convex top surface shaped to define a plurality of airfoil shaped sections radiating outwards from a center of the body, and an open concave bottom; and a slot arranged in the leading edge of each airfoil shaped disc section such that air may pass through said slot from the top surface of the toy to beneath the toy.

Preferably each airfoil shaped disc section is angled upwards and forwards from a trailing edge to a leading edge and is arranged such that the leading edge of each airfoil shaped section lies next to the trailing edge of an adjacent airfoil shaped section. The leading and trailing edges of adjacent airfoil shaped disc sections are joined by a face extending downwards from the leading edge to the adjacent trailing edge. The leading and trailing edges of the airfoils also preferably curve counter clockwise, or rearwardly in the direction of rotation as they extend radially outwards from the center.

The concave bottom of the disc body may be shaped similarly to the top surface of the disc body. This provides a plurality of depressions in the bottom of the disc each having a shape similar to the airfoils.

Each slot is preferably arranged in the face extending downwards from the leading edge of a respective airfoil shaped section and extends along the leading edge.

It is believed that the airfoil shaped disc sections and the slots improve the aerodynamic characteristics of the toy enabling it to remain in the air for a longer period of time when thrown, and causing the toy to tend to level itself while airborne.

The toy may include light emitting means, usually one or more electric lights, arranged at various locations on the disc body. The lights may be of various colours, and may be arranged to flash on and off. Preferably the light emitting means comprise three lights spaced apart and arranged in the face of each airfoil above the slot. A battery holder for holding batteries to power the coloured lights may be located at a center of the bottom of the body.

The toy may also include sound generator means, either in conjunction with the light emitting means or independently. One example of an appropriate sound generator means which may be used on the toy is a whistle.

BRIEF DESCRIPTION OF THE DRAWINGS

In the accompanying drawings, which illustrate an exemplary embodiment of the present invention.

DETAILED DESCRIPTION

Figure 1:
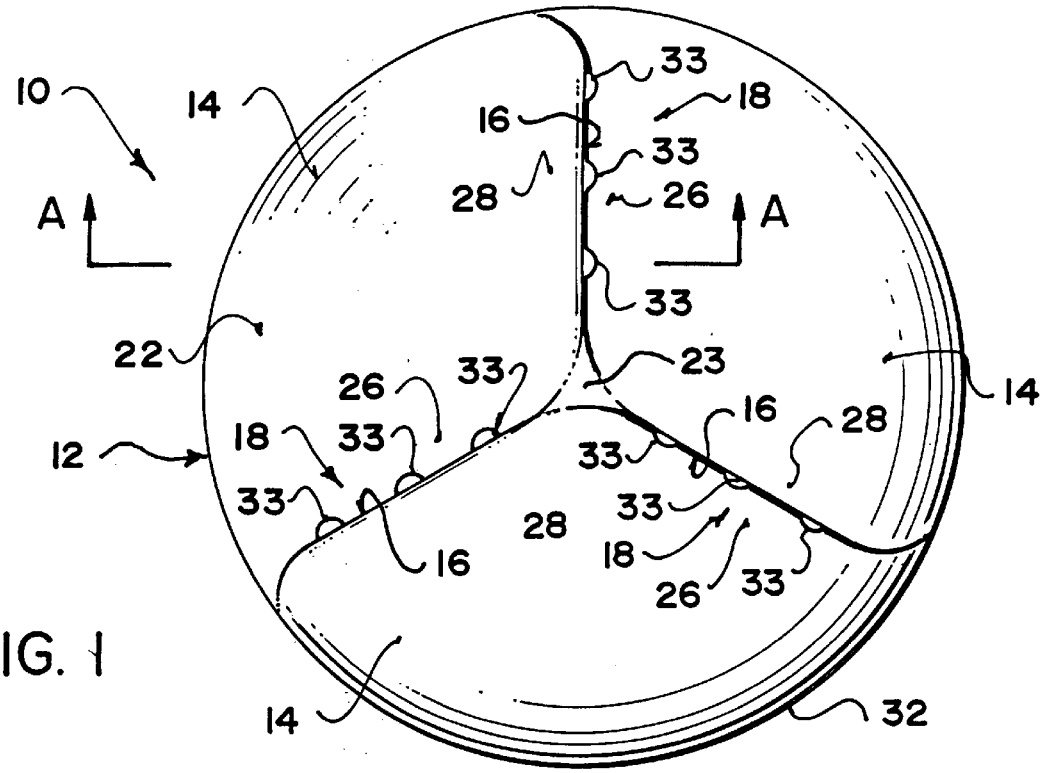
FIG. 1 is a top view of the toy.
Figure 2:
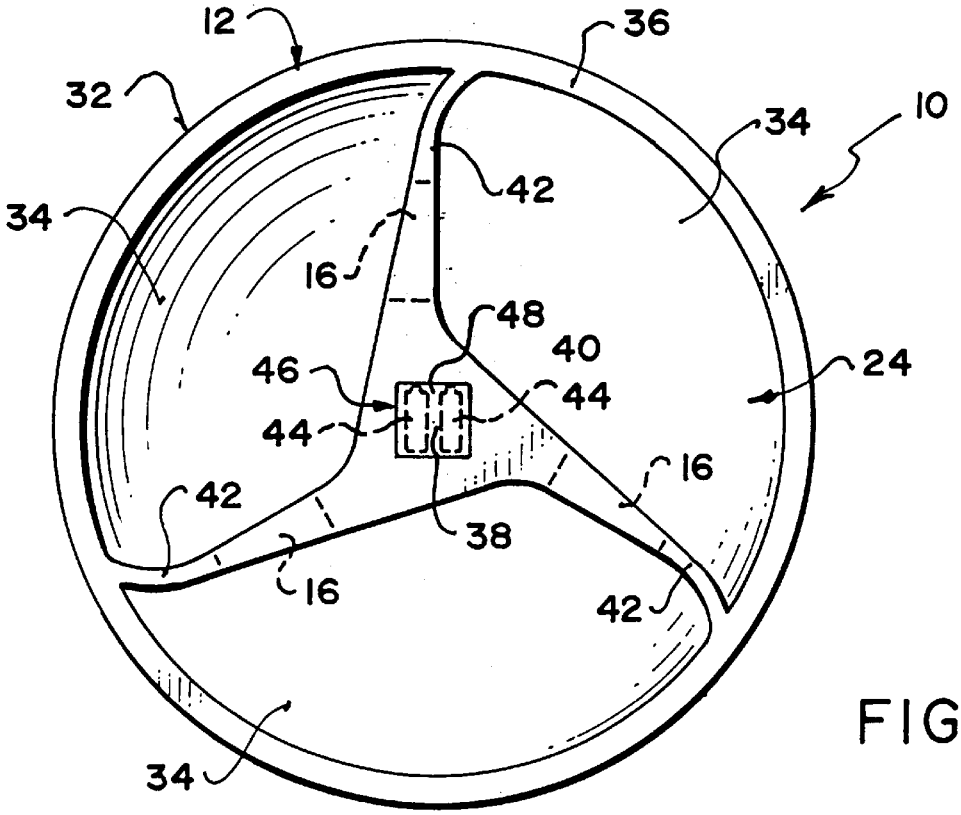
FIG. 2 is a bottom view of the toy.
Figure 3:
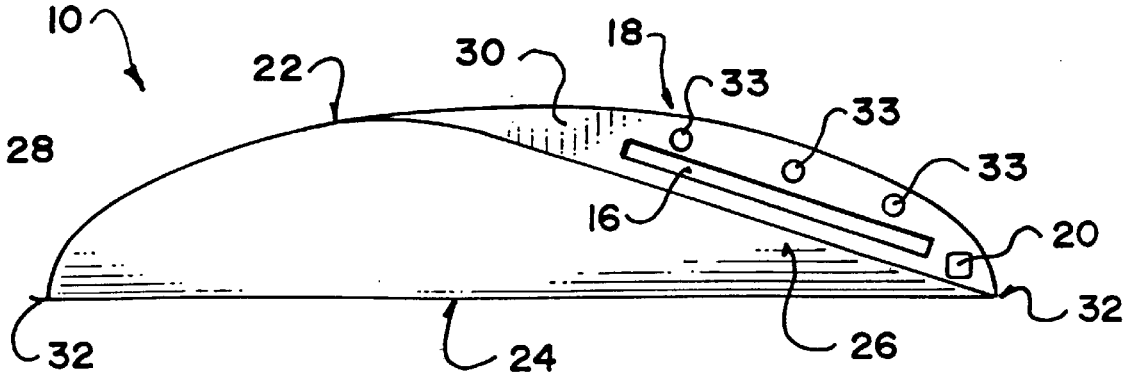
FIG. 3 is a side view of the toy.
Figure 4:
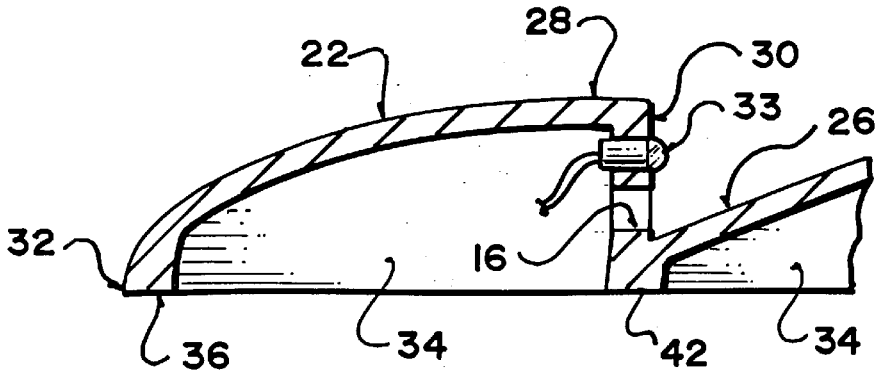
FIG. 4 is a cross sectional view through A—A of FIG. 1.

Referring to FIGS. 1, 2 and 3 the aerodynamic toy is shown generally at 10. The toy 10 comprises a disc shaped body 12 having a plurality of air foil shaped sections 14, and a plurality of slots 16 in the body 12. Light emitting means 18 and sound generating means 20 may also be included to enhance the amusement value of the toy 10. The aerodynamic toy 10 is manually launched into flight by throwing it, usually with one hand, such that it spins about an axis substantially normal to the center of the disc when in flight.

The disc shaped body 12 has a substantially convex top surface 22 and an open concave bottom 24. The convex top surface 22 is shaped such that it defines the plurality of airfoil sections 14 which radiate outwards from the center 23 of the body 12. Each airfoil shaped disc section 14 is angled upwards and forwards from a trailing edge 26 to a leading edge 28 and is arranged such that the leading edge 28 of each airfoil shaped section 14 lies next to the trailing edge 26 of an adjacent airfoil shaped section. In the embodiment illustrated, three air foil sections are shown each of which sweeps through approximately 120 degrees.

Each airfoil shaped disc section 14 is connected to the trailing edge 26 of an adjacent section by a face 30 extending downwards from the leading edge 28 to the trailing edge 26. The leading edge 28 and trailing edge 26 of each of the airfoil sections 14 curve counter clockwise, or rearwardly in the normal direction of rotation, as they extend radially outwards from the center 23 of the disc body 10. A circular outer perimeter edge 32 of the disk body 10 is defined by the outermost edges of the airfoil shaped sections 14.

The concave bottom 24 of the disc body 12 is shaped similarly to the top surface 22 of the disc body 12, with a plurality of depressions 34 following the top curvature of the airfoils. Each depression 34 has a shape like that of one of the airfoils 14. A rim 36 extends inwards towards the center 38 of the bottom 24 of the disc body 12 from the outer edge 32 of the disc. The rim 36 gives the disc additional strength. A center portion 40 projects downwards from the bottom 24 of the disc body 12 between the depressions 34. Separating adjacent depressions 34 are ridges 42 extending from the center portion 40 to the outer rim 36. The ridges 42 each follow the curve of the leading and trailing edges 28 and 26 as they extend radially out from the center 40.

The plurality of slots 16 are arranged in the disc body 12 such that one is located in the leading edge 28 of a each airfoil shaped disc section 14. The slots 16 provide openings through the disc body 12 such that air can pass through these openings from the top surface 22 of the toy 10 to beneath the toy 10. Each slot 16 is arranged in the face 30 of the leading edge 28 of a respective air foil 14 extending along the leading edge 28 between the leading edge 28 and the adjacent trailing edge 26.

It is believed that the air foil shaped disc sections 14, the depressions in the bottom 24 of the disc body 12, and the slots 16 improve the aerodynamic characteristics of the toy 10 enabling it to remain in the air for a longer period of time when thrown, and causing the toy 10 to tend to level itself while airborne.

The toy 10 may include light emitting means 18, usually one or more electric lights 33, arranged at various locations on the disc body 10. The electric lights 33 may be of various colours, and may be arranged to flash on and off. In the illustrated embodiment the light emitting means 18 comprise three spaced apart lights 33 arranged above the slot 16 in the face 30 of each air foil shaped section 14.

Batteries 44 are provided to supply power to the lights 33. The batteries 44 are stored in a battery holder 46 located at a center 23 of the bottom 24 of the disc body 12. The battery holder 46 comprises a recess 48 in the raised center portion 40 of the bottom 24 of the disc body 12. Means for containing the batteries 44 within the battery holder 46, such as a lid, are provided for securing the batteries 44 when the toy 10 is in flight.

The toy 10 also may include sound generator means 20. The sound generator means 20 may be whistles or like devices, however any appropriate means of generating sound 20, including electronic devices, may be used.

The above describes a right handed version of the toy which rotates clockwise when in flight. A left hand version of the toy would rotate counter-clockwise in flight and would be the mirror image of the embodiment described above.

While one embodiment of the present invention has been described in the foregoing, it is to be understood that other embodiments are possible within the scope of the invention. The invention is to be considered limited solely by the scope of the appended claims.

I claim:

1. An aerodynamic toy for manually launching into flight comprising:

a disc shaped body having a substantially convex top surface shaped to define a plurality of airfoil sections radiating outwards from a center of the body, and an open concave bottom;

a connecting face extending downwards from a leading edge of each airfoil section to a trailing edge of an adjacent airfoil section; and a slot adjacent the leading edge of each airfoil section such that air may pass through said slot from the top surface of the toy to beneath the toy.

2. An aerodynamic toy according to claim 1 wherein the concave bottom is shaped similarly to the top surface of the disc body.

3. An aerodynamic toy according to claim 1 wherein the slots are in the respective connecting faces.

4. An aerodynamic toy according to claim 1 wherein the leading edge and trailing edge of each airfoil curve counter clockwise as they extend radially outwards from the center of the disc body.

5. An aerodynamic toy to be launched manually into flight, said top comprising:

a disc shaped body having a substantially convex top surface shaped to define a plurality of airfoil sections radiating outwards from a center of the body, and an open concave bottom;

a slot adjacent a leading edge of each airfoil section such that air may pass through said slot from the top surface of the toy to beneath the toy; and light emitting means mounted on the body adjacent the leading edge of each airfoil.

6. An aerodynamic toy according to claim 1 wherein light emitting means are mounted in each connecting face above the slot.

7. An aerodynamic toy according to claim 5 including means for causing the light emitting means to flash on and off.

8. An aerodynamic toy according to claim 5 wherein the light emitting means comprise electric lights.

9. An aerodynamic toy according to claim 6 wherein there are three electric lights spaced apart and arranged in each connecting face.

10. An aerodynamic toy according to claim 8 wherein the electric lights are of differing colours.

11. An aerodynamic toy according to claim 8 wherein the toy includes a battery holder for holding at least one electric battery and means connecting the lights to the battery to power the lights.

12. An aerodynamic toy according to claim 11 wherein the battery holder is located at a center of the bottom of the body.

13. An aerodynamic toy according to claim 1 wherein the toy includes sound generator means arranged thereon.

14. An aerodynamic toy according to claim 13 wherein the sound generator means comprise at least one whistle.

* * * * *